US006521188B1

(12) United States Patent
Webster

(10) Patent No.: US 6,521,188 B1
(45) Date of Patent: Feb. 18, 2003

(54) MICROFLUIDIC ACTUATOR

(75) Inventor: James Russell Webster, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 161 days.

(21) Appl. No.: 09/717,015

(22) Filed: Nov. 22, 2000

(51) Int. Cl.[7] ..... B01L 3/00

(52) U.S. Cl. ..... 422/100; 422/99; 422/103; 137/14; 137/833

(58) Field of Search ..... 422/68.1, 82.01, 422/82.05, 99, 100, 102, 103; 435/283.1, 287.1, 287.3, 287.8, 288.4, 288.5; 204/400, 415; 137/14, 833; 156/625.1, 626.1, 662.1

(56) References Cited

U.S. PATENT DOCUMENTS

| | | | | | |
|---|---|---|---|---|---|
| 4,797,259 | A | * | 1/1989 | Matkovich et al. | 422/101 |
| 4,885,253 | A | * | 12/1989 | Kralovic | 435/296 |
| 5,147,923 | A | * | 9/1992 | Mueller | 524/555 |
| 5,451,362 | A | * | 9/1995 | Wombwell et al. | 264/328.6 |
| 5,584,432 | A | * | 12/1996 | Lockhart | 236/93 |
| 5,603,953 | A | * | 2/1997 | Herbig et al. | 424/473 |
| 5,849,208 | A | * | 12/1998 | Hayes et al. | 216/94 |
| 5,922,591 | A | * | 7/1999 | Anderson et al. | 435/287.2 |
| 6,063,589 | A | * | 5/2000 | Kellogg et al. | 435/24 |
| 6,068,751 | A | * | 5/2000 | Neukermans | 204/601 |
| 6,228,922 | B1 | * | 5/2001 | Wang et al. | 524/413 |
| 6,334,980 | B1 | * | 1/2002 | Hayes et al. | 422/68.1 |
| 6,379,929 | B1 | * | 4/2002 | Burns et al. | 435/91.2 |
| 6,453,928 | B1 | * | 9/2002 | Kaplan et al. | 137/14 |

OTHER PUBLICATIONS

Anderson et al., Microfluidic Biochemical Analysis System, 4 pages.

Guerin et al., Miniature One–Shot Valve, pp. 425–428.

Anderson et al., A Miniature Integrated Device for Automated Multistep Genetic Assays; Apr. 15, 2000, 6 pages, Nucleic Acids Research, 2000, vol. 28, No. 12.

Lagally et al., Microfabrication Technology For Chemical and Biochemical Microprocessors; 2000, Micro Total Analysis Systems 2000, pp. 217–220.

* cited by examiner

*Primary Examiner*—Jill Warden
*Assistant Examiner*—Dwayne K. Handy
(74) *Attorney, Agent, or Firm*—Bacon & Thomas

(57) ABSTRACT

A simple microfluidic actuator includes a sealed vacuum chamber actuated by providing a current to a thin film heater, which in turn weakens and, under the atmospheric pressure differential, breaks a diaphragm sealing said vacuum chamber whereby the vacuum inside said chamber is released. By applying the microfluidic actuator to a microfluidic network the resulting pressure differential can be used to generate a pumping force with the microfluidic network. The chamber may be prepared in a silicon, glass, or plastic substrate. The diaphragm may be a metallic gas-impermeable film. A releasing member comprising a thin-film metallic heater is then microfabricated on the diaphragm. The assembly so prepared may be bonded to a glass or plastic substrate that contains a network of microchannels. The microfluidic actuator is suited for a microfluidic platform in generating driving powers for operations including pumping, metering, mixing and valving of liquid samples.

21 Claims, 2 Drawing Sheets

MICROFLUIDIC ACTUATOR

FIELD OF THE INVENTION

The present invention relates to a microfluidic actuator, especially to an actuator that generates pumping force to a microfluid with a vacuum chamber.

BACKGROUND OF THE INVENTION

Miniature pumps and valves have been a topic of great interest in the past 10 years. Many different pump and valve designs have been implemented by micromachining of silicon and glass substrates. Pumps and valves with pneumatic, thermal-pneumatic, piezoelectric, thermal-electric, shape memory alloy, and a variety of other actuation mechanisms have been realized with this technology. Although such pumps to date have shown excellent performance as discrete devices, often the processes for fabricating these pumps and valves are so unique that the devices cannot be integrated into a complex microfluidic system. Recently, paraffin actuated valves, and hydrogel actuated valves are being developed on the way to a more complex microfluidic platform.

Miniature analytical analysis systems, however, are demanding pumps and valves that are relatively small in size and can be integrated together on a single substrate. Systems to perform sample processing for DNA analysis are one such example. Such systems can require anywhere from 10–100 such pumps and valves to perform a variety of pumping, mixing, metering, and chemical reactions that are required to extract DNA from a sample, amplify the DNA, and analyze the DNA. To date no such technology exists to perform this type of microfluidic sample processing.

Anderson, et al. demonstrated the concept by using external air sources, external solenoid valves and a combination of thin film valves and vents on a plastic analysis cartridge. The entire sample handling for DNA extraction, in vitro transcription and hybridization was performed in a prototype system. See: "Microfluidic Biochemical Analysis System", Proceedings of Transducers '97, the 9th International Conference on Solid-State Sensors and Actuators, Chicago, Jun. 16–19, 1997, 477–480 and "A Miniature Integrated Device for Automated Multistep Genetic Assays", Nucleic Acids Research, 2000 Vol 28 N 12, e60.

Recently, Mathies et al. employed the same technology to perform a polymerase chain reaction (PCR) followed by a capillary electrophoresis (CE) analysis on the same device ("Microfabrication Technology for Chemical and Biochemical Microprocessors", A. van den Berg (ed.), Micro Total Analysis Systems 2000, 217–220). For applications in which sample contamination is of concern, such as diagnostics, disposable devices are very appropriate. In this case the manufacturing cost of such a device must be extremely low.

i-STAT corporation currently markets a disposable device that analyzes blood gases as well as a variety of ions. The i-STAT cartridge uses external physical pressure to break on-chip fluid pouches and pump samples over ion-selective sensors (i-STAT Corporation Product Literature, June 1998). In a similar manner, Kodak has developed a PCR-based HIV test in a disposable, plastic blister pouch (Findlay, J. B. et al., Clinical Chemistry, 39, 1927–1933 (1993)). After the PCR reaction an external roller pushes the PCR product followed by binding, washing and labeling reagents into a detection area where the PCR amplified product can be detected. The complexity of such systems as these is limited in part by the means of pressure generation. The simplicity of these approaches however is quite elegant.

Disposable, one-shot microfabricated valves have been implemented by a few researchers for diagnostic applications. Guerin et al. developed a miniature one-shot (irreversible) valve that is actuated by melting an adhesive layer simultaneously with the application of applied pressure of the fluidic medium. See: "A Miniature One-Shot Valve", Proceedings of IEEE conference on Micro-Electro-Mechanical Systems, MEMS '98, 425–428. In this invention, if the applied pressure is high enough the melted adhesive layer gives way and the fluid passes through the valve.

Another one-shot type valve has been developed by Madou et al. in their U.S. Pat. No. 5,368,704, "Microelectrochemical Valves and Method". Here the valve is actuated by the electrochemical corrosion of a metal diaphragm.

While complex microfluidic systems have been demonstrated using external air supplies and solenoid valves, a need exists for complex microfluidic systems in more portable instrument platforms. It is thus necessary to provide an actuator that provides actuation sources and that can be equipped directly on the device in which the actuator is used.

OBJECTIVES OF THE INVENTION

The objective of the present invention is to provide a one-time microfluidic actuator.

Another objective of this invention is to provide a microfluidic actuator that is easy to prepare under a relatively low cost.

Another objective of this invention is to provide a microfluidic actuator with a vacuum chamber.

Another objective of this invention is to provide a microfluidic module comprising an actuator with a vacuum chamber.

Another objective of this invention is to provide a microfluidic device wherein the actuation sources are directly prepared on the device itself.

Another objective of this invention is to provide a novel method for the preparation of a microfluid module comprising a vacuum chamber actuator to actuate the microfluidic functions.

SUMMARY OF THE INVENTION

According to the present invention, a simple microfluidic actuator is disclosed. The microfluidic actuator of this invention comprises a sealed vacuum chamber. The vacuum chamber is actuated by providing a current to a thin film heater, which in turn weakens and, under the atmospheric pressure differential, punctures a diaphragm sealing said vacuum chamber whereby the vacuum inside said chamber is released. By applying the microfluidic actuator of this invention to a microfluidic network, the resulting pressure differential can be used to generate a pumping force within the microfluidic network. In the preferred embodiments of this invention, the chamber may be prepared in a silicon, glass, or plastic substrate and a diaphragm is vacuum bonded to seal the chamber. The diaphragm may comprise a metallic gas-impermeable film. A releasing member comprising a thin-film metallic heater is then microfabricated on the diaphragm. The assembly so prepared may be bonded to a glass or plastic substrate that contains a network of microchannels. The invented microfluidic actuator is suited for a microfluidic platform in generating driving forces for operations including pumping, metering, mixing and valving of microfluidic samples.

These and other objectives and advantages of the present invention may be clearly understood from the detailed description by referring to the following drawings.

DETAILED DESCRIPTION OF THE INVENTION

According to the present invention, a simple microfluidic actuator is provided. The microfluidic actuator of this invention comprises a sealed vacuum chamber that generates a pumping force when the vacuum inside the chamber is released. The pumping force of the vacuum chamber is actuated by providing a current to a thin film heater positioned on a diaphragm sealing said vacuum chamber. The provided current weakens and, under the atmospheric pressure differential, punctures the diaphragm whereby the vacuum inside said chamber is released.

The microfluidic actuator of this invention may be applied to a microfluidic network, such that the resulting pressure differential generated by the released vacuum can be used as a pumping force within the microfluidic network.

The following is a detailed description of the embodiments of the microfluidic actuator of this invention by referring to microfluidic networks employing the invented microfluidic actuator.

EMBODIMENT I

Figure 1:
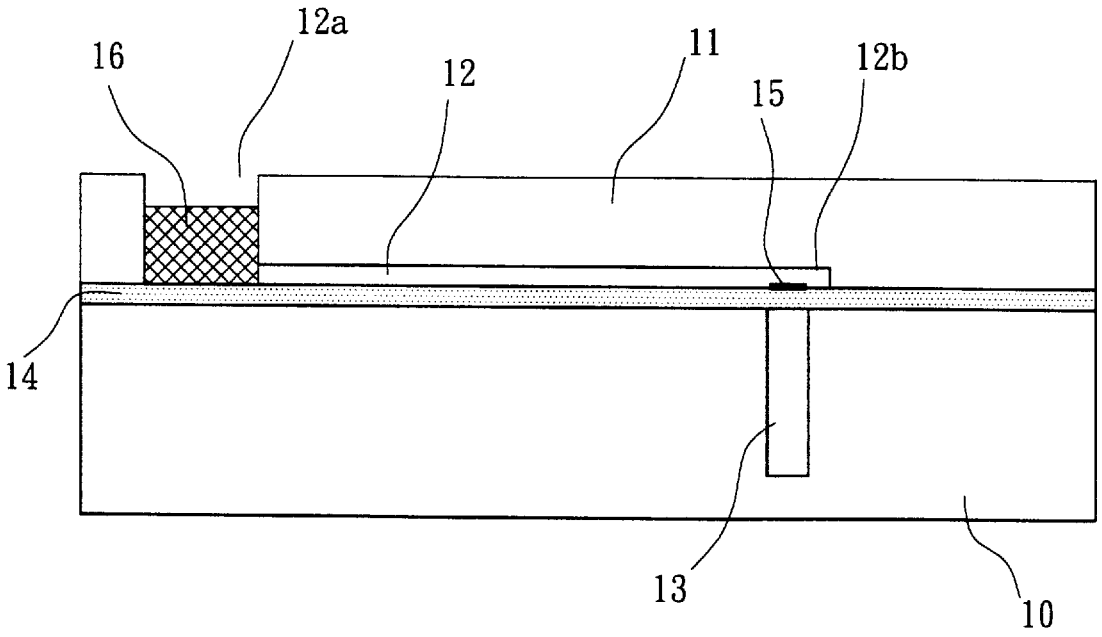
FIG. 1 shows the cross sectional view of a microfluid pumping mechanism equipped with the microfluidic actuator of this invention prior to actuation.
Figure 2:
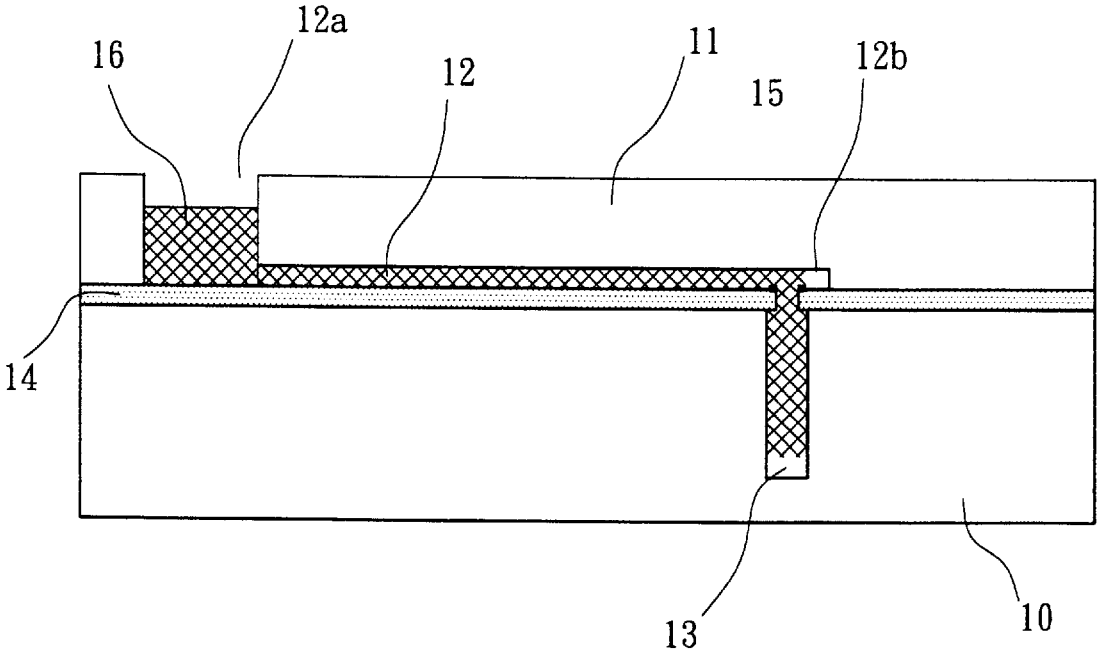
FIG. 2 shows its cross sectional view after actuation.

Embodiment I pertains to a microfluid pumping mechanism employing the microfluidic actuator of this invention. FIG. 1 shows the cross sectional view of a microfluid pumping mechanism employing the microfluidic actuator of this invention prior to actuation and FIG. 2 shows its cross sectional view after actuation. As shown in FIGS. 1 and 2, the microfluid pumping mechanism comprises a bottom substrate 10 and an upper substrate 11, a microfluid channel 12 inside said upper substrate 11, a vacuum chamber 13 under said microfluid channel 12, a diaphragm 14 sealing said vacuum chamber 13, and a thin film resistor 15. 16 represents fluid filled into the microfluid channel 12. As shown in FIG. 1, the microchannel 12 has a sealed end 12*b* and an open end 12*a* and the vacuum chamber 13 is positioned adjacent to the sealed end 12*a* of the microchannel 12. Fluid 16, such as a liquid, is filled into the open end 12*a* of the microchannel 12. The open end 12*a* forms a reservoir for the fluid 16.

The vacuum chamber 13 is contained in the bottom substrate 10 while the upper substrate 11 contains the microfluid channel 12. Between the substrates 10 and 11 is the thin diaphragm 14 on which a thin film resistor 15 is positioned whereby the thin diaphragm 14 and the thin film resistor 15 are positioned above the vacuum chamber 13. By applying a current to the thin film resistor 15, heat is generated by the thin film resistor 15 such that the diaphragm 14 above the vacuum chamber 13 breaks whereby the vacuum inside the vacuum chamber 13 is released and the liquid 16 is pumped into the microchannel 12 until the pressure inside the microchannel 12 reaches equilibrium. The result is shown in FIG. 2.

EMBODIMENT II

Embodiment II discloses a mechanism for proportionally mixing microfluidic samples using the invented microfluidic actuator. The microfluid mixing mechanism of this embodiment comprises in general a vacuum chamber 31, a mixing chamber 39 and at least 2 microchannels 32 and 33 connected to the mixing chamber 39, allowing liquid samples to flow into the mixing chamber 39. A schematic of one such proportional mixing system is shown in FIG. 3.

Figure 3:
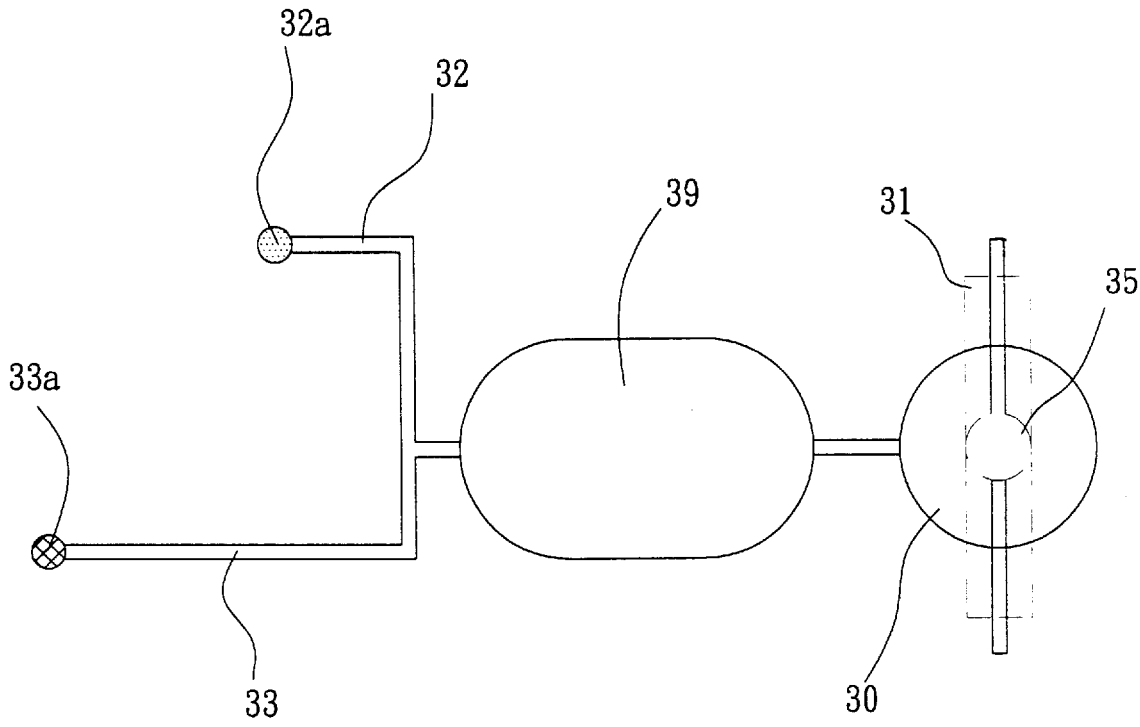
FIG. 3 shows another microfluid pumping mechanism employing the microfluidic actuator of this invention.

As shown in FIG. 3, the microfluid mixing mechanism also comprises an air reservoir 30 connected to the mixing chamber 39, a thin diaphragm (not shown in FIG. 3) separating the air reservoir 30 and the vacuum chamber 31, a thin film resistor 35 positioned on the this diaphragm, and two sample inlets of reservoirs 32*a* and 33*a* for filling sample liquids into the microchannels 32 and 33.

Before actuating the microfluidic actuator of this invention, sample liquids are added into the sample inlets 32*a* and 33*a* and fill the inlets 32*a* and 33*a* and a portion of the microchannels 32 and 33. Upon actuation, a current is supplied to the thin film resistor 35 which generates heat and breaks the thin diaphragm, whereby the vacuum inside the vacuum chamber 31 is released. Sample liquids in the reservoirs 32*a* and 33*a* are then pumped into the mixing chamber 39 and mixed in proportion to the sum of the fluidic resistances of their respective fluidic channels 32 and 33 and the fluidic resistance of the mixing chamber 39.

In this Embodiment II, the microfluid mixing mechanism comprises at least two microchannels and a vacuum chamber in which the pressure of the vacuum, volume of the vacuum chamber and air volume of the interconnecting channels are precisely designed to pump a predetermined amount of sample fluid from a larger fluidic supply to a specific destination.

PREPARATION OF THE MICROFLUIDIC ACTUATOR

As described above, the microfluidic actuator of this invention comprises in general a microchannel and a vacuum chamber sealed with a thin diaphragm, on which a thin film resistor is provided. In the preparation of a microfluidic network system employing the microfluidic actuator of this invention, the microfluidic actuator of this invention may be divided into two parts, wherein the upper substrate 11 contains a microchannel 12 and the bottom substrate 10 contains the vacuum chamber 13. In the upper substrate 11 is provided a reservoir 12*a* and in the bottom substrate 10 is provided a thin diaphragm 14 sealing the vacuum chamber 13 and a thin film resistor 15 above the thin diaphragm 14 and the vacuum chamber 13.

The upper substrate 11 and the bottom substrates 10 may be prepared with glass, silicon or plastic with microfabricated channels and chambers respectively. The thin diaphragm 14 may be a metallized polymeric diaphragm, preferably a pressure sensitive cellophane tape. The thin film resister 15 may be a microfabricated silver film resistor to provide a resistance of approximately 2 ohms, such that it may function as a heater to melt the thin diaphragm 14. The two substrates 10 and 11 and their intermediate layer are vacuum bonded together resulting in a sealed vacuum chamber 13 in the bottom substrate 10. A hot wax melt may be used in bonding the two substrates 10 and 11. For purposes of simplicity, the vacuum chamber 13 is placed in the bottom substrate 10 but it should not be a limitation of this invention. Vacuum processing is then applied to the assembly. The microfluidic actuator of this invention is thus prepared.

Prior to actuation, liquid is added into the reservoir 12*a* and fills the reservoir 12*a*. Upon application of, for example, 3 volts to the thin film resistor 15, the thin diaphragm 14 is equalized. The pumping speed is a function of the vacuum chamber pressure and the total fluidic resistance of the channel network.

The invented microfluidic actuator is suited for a microfluidic platform in generating driving forces for operations including pumping, metering, mixing and valving of liquid samples.

EFFECTS OF THE INVENTION

The present invention discloses an actuation mechanism for microfluidic devices based on the one-time release of vacuum from a small vacuum chamber. Actuation is achieved by applying an electrical current to a thin film resistor which heats and breaks a diaphragm, thereby releasing the vacuum. The present invention contemplates methods for pumping, valving, metering, and mixing liquid samples based upon this actuation mechanism. Since the pump and valves in this invention can be integrated into a planar process, highly complex systems can be realized as compared with many microfabricated pumps and valves that are not readily integrated in a planar process.

The microfluidic actuator of this invention may be prepared in a chip containing a microfluidic system. By placing the actuator on the chip itself, the motion of liquids within the microfluidic system can be controlled by electrical signals alone. This flexibility reduces the complexity of the device operating instruments, since all pressure sources and valves are contained within the device itself. Therefore more portable assays can be realized such as hand held instruments. Furthermore, the present invention eliminates the need for making external air duct connections to the device.

As the present invention has been shown and described with reference to preferred embodiments thereof, those skilled in the art will recognize that the above and other changes may be made therein without departing form the spirit and scope of the invention.

What is claimed is:

1. A microfluidic actuator to provide a driving force to a microfluidic channel, comprising a sealed vacuum chamber containing a vacuum and situated adjacent to said microfluidic channel, a diaphragm arranged to separate said vacuum chamber from said microfluidic channel, and a releasing member arranged to unseal said vacuum chamber and release said vacuum into said microfluidic channel, said vacuum drawing a fluid into said microfluidic channel.

2. The microfluidic actuator according to claim 1 wherein said diaphragm comprises a metallized polymeric diaphragm.

3. The microfluidic actuator according to claim 1 wherein said diaphragm comprises a pressure sensitive cellophane tape.

4. The microfluidic actuator according to claim 1 wherein said vacuum chamber is prepared in a glass, silicon or plastic substrate.

5. The microfluidic actuator according to claim 1 wherein said releasing member comprises a heater to generate sufficient heat to break at least a portion of said diaphragm between said vacuum chamber and said microfluidic channel.

6. The microfluidic actuator according to claim 5 wherein said heater comprises a thin film resistor positioned adjacent to said diaphragm.

7. The microfluidic actuator according to claim 1 wherein said microchannel comprises at least two branch channels connecting to said microchannel wherein volumes of said branch channels are in proportion.

8. A microfluidic channel system comprising a substrate, a microfluidic channel in said substrate, a sealed vacuum chamber in said substrate containing a vacuum and situated adjacent to said microfluidic channel, a diaphragm arranged to separate said vacuum chamber from said microfluidic channel, and a releasing member arranged to unseal said vacuum chamber and release said vacuum into said microfluidic channel, said vacuum drawing a fluid into said microfluidic channel.

9. The microfluidic channel system according to claim 8 wherein said diaphragm comprises a metallized polymeric diaphragm.

10. The microfluidic channel system according to claim 8 wherein said diaphragm comprises a pressure sensitive cellophane tape.

11. The microfluidic channel system according to claim 8 wherein said releasing member comprises a heater to generate sufficient heat to break at least a portion of said diaphragm between said vacuum chamber and said microfluidic channel.

12. The microfluidic channel system according to claim 11 wherein said heater comprises a thin film resistor positioned against said diaphragm.

13. The microfluidic channel system according to claim 8 wherein material of said substrate is selected from the group consisted of glass, silicon and plastics.

14. The microfluidic channel system according to claim 8 wherein said microchannel comprises at least two branch channels connecting to said microchannel wherein volumes of said branch channels are in proportion.

15. A method to prepare a microfluidic channel system, comprising:

preparing a first substrate containing a microfluidic channel;

preparing a second substrate containing a vacuum chamber sealed with a diaphragm to contain a vacuum;

positioning a heater on said diaphragm;

bonding said first substrate to said second substrate whereby said vacuum chamber is adjacent to said microfluidic channel;

whereby said vacuum chamber and said microfluidic channel are separated by said diaphragm and whereby said heater is positioned at a portion of said diaphragm separating said vacuum chamber and said microfluidic channel, so that said heater may be activated causing said heater to open said diaphragm and release said vacuum into said microfluidic channel, said vacuum chamber drawing said fluid into said microchannel.

16. The method according to claim 15 wherein said diaphragm comprises a metallized polymeric diaphragm.

17. The method according to claim 15 wherein said diaphragm comprises a pressure sensitive cellophane tape.

18. The method according to claim 15 wherein said heater comprises a thin film resistor.

19. The method according to claim 18 wherein said heater comprises a microfabricated silver film.

20. The method according to claim 15 wherein material of said substrate is selected from the group consisted of glass, silicon and plastics.

21. The method according to claim 15 wherein said microchannel comprises at least two branch channels connecting to said microchannel wherein volumes of said branch channels are in proportion.

* * * * *